US006644657B2

(12) United States Patent
Wright et al.

(10) Patent No.: US 6,644,657 B2
(45) Date of Patent: Nov. 11, 2003

(54) ACCUMULATOR HAVING POWER RAMP

(75) Inventors: William J. Wright, Killingworth, CT (US); Rebecca J. Anderson, Pawling, NY (US)

(73) Assignee: Pitney Bowes Inc., Stamford, CT (US)

( * ) Notice: Subject to any disclaimer, the term of this patent is extended or adjusted under 35 U.S.C. 154(b) by 167 days.

(21) Appl. No.: 10/029,337

(22) Filed: Oct. 25, 2001

(65) Prior Publication Data

US 2003/0080503 A1 May 1, 2003

(51) Int. Cl.[7] ..... B65G 57/06; B65H 31/30; B65H 9/08

(52) U.S. Cl. ..... 271/242; 271/3.01; 271/3.03; 414/790.7

(58) Field of Search ..... 271/3.01, 3.03, 271/242, 303, 298; 414/790.7

(56) References Cited

U.S. PATENT DOCUMENTS

| | | | | | |
|---|---|---|---|---|---|
| 4,640,506 | A | | 2/1987 | Luperti et al. | 271/212 |
| 4,805,891 | A | | 2/1989 | Luperti et al. | 271/212 |
| 4,925,362 | A | * | 5/1990 | Golicz | 414/790.7 |
| 5,083,769 | A | | 1/1992 | Young, Jr. | 271/280 |
| 5,094,443 | A | * | 3/1992 | Young, Jr. | 271/245 |
| 5,147,092 | A | * | 9/1992 | Driscoll et al. | 271/184 |
| 5,178,379 | A | * | 1/1993 | Edwards et al. | 271/189 |
| 5,244,200 | A | * | 9/1993 | Manzke | 271/198 |
| 5,297,783 | A | | 3/1994 | Howard et al. | 270/52.5 |
| 5,342,038 | A | * | 8/1994 | Suter | 271/198 |
| 5,354,171 | A | * | 10/1994 | Mercede, Jr. | 414/790.2 |
| 5,364,085 | A | * | 11/1994 | Kennish | 270/58.02 |
| 5,375,825 | A | * | 12/1994 | Kennish | 270/58.02 |
| 5,435,534 | A | | 7/1995 | Linkowski et al. | 270/51 |
| 5,445,368 | A | * | 8/1995 | Lester et al. | 270/59 |
| 5,484,255 | A | | 1/1996 | Lowell | 414/789 |
| 5,492,318 | A | | 2/1996 | Wright | 271/211 |
| 5,566,932 | A | * | 10/1996 | Hubbard | 271/245 |
| 5,772,202 | A | * | 6/1998 | Singer et al. | 271/246 |
| 5,775,689 | A | * | 7/1998 | Moser et al. | 271/198 |
| 5,915,686 | A | * | 6/1999 | Neifert et al. | 271/198 |
| 5,947,461 | A | | 9/1999 | Holbrock | 270/52.09 |
| 6,161,828 | A | | 12/2000 | Sussmeier | 270/59 |
| 6,551,052 | B2 | * | 4/2003 | Bakoledis | 414/790.3 |

* cited by examiner

*Primary Examiner*—Donald P. Walsh
*Assistant Examiner*—Daniel Schlak
(74) *Attorney, Agent, or Firm*—Michael J. Cummings; Charles R. Malandra, Jr.; Angelo N. Chaclas

(57) ABSTRACT

The present invention concerns a document processing and collating machine having a feeding path leading to at least one document conveying devices having one or more document accumulating bins for receiving a series of documents that are fed downstream in spaced apart collations with documents in shingled relationship. The document accumulator bins have an intermediate conveying and diverting apparatus which is momentarily engaged to cause a leading end of a shingled collation of documents to be diverted into a document accumulating bin where the documents are registered at their common leading end at a nip of a set of downstream conveying rollers that are stopped during the registration process.

14 Claims, 8 Drawing Sheets

ACCUMULATOR HAVING POWER RAMP

FIELD OF THE INVENTION

The instant invention generally relates to a document accumulating transport, (also known as a collator, sheet accumulator, document accumulator, accumulator or dual accumulator) which is part of a high-speed document feeding system. The accumulator is utilized in a document processing system for collating sets of documents (also known as collations or sub-sets of documents or sheets) being processed for delivery to a customer or client in groups, document packets, or collation assemblies all of which may be inserted into a waiting envelope in a document processing machine such as that described above. There may be one document or sheet-feeding path in the accumulator, or two such as that common in a dual accumulator where the document feeding paths are arranged in parallel relationship. Such an accumulator has utility in an inserting machine that typically processes sheets in the form of individual inserts or sets of inserts or collations to be inserted into an envelope. The documents are initially advanced towards the document accumulator by document feeding apparatus that shingles them prior to reaching the input side of the accumulating apparatus.

BACKGROUND OF THE INVENTION

It has been a common solution that sheet or document processing equipment such as inserting equipment have document accumulating systems such as dual accumulators or accumulators that have one or more accumulator bins in order to help maintain the highest possible throughput of the documents or sheets through the equipment. The additional accumulator bins are especially helpful in providing higher throughput or output of documents in collations or subsets of documents. It is also often a requirement that the document accumulating systems within such equipment must be able to provide subsets of document or sheet material within a collation that will eventually be inserted into an envelope.

While individual sheets are conveyed serially and processed serially in such document accumulating systems, provisions for accepting an entire subset or collation that is shingled while entering each collating bin has not been provided. Prior art such as that described in U.S. Pat. No. 5,083,769 to Young illustrates the handling of sheets in serial relationship, and for depositing single sheets in two accumulator bins of a dual accumulator.

It is now desirable to process sheets or documents that are shingled or overlapped in shingled relationship to form subsets or collations that are typically arranged with the lower sheet being the first document of the subset or collation. These collations of shingled documents are fed along a conveyor from an input source in spaced apart relationship that leads to an accumulator having one or more accumulator bins. The shingled relationship of individual sheets or documents has come about in an effort to process a greater quantity of such documents in equipment such as that described above. When this shingling process is used, the shingled document subset or collation must then be registered or justified at some point within the accumulator bin of the document accumulator for further processing as a completed document collation ready for further processing downstream in the equipment.

There are various schemes and apparatus known in the document-processing field that will ramp or lift individual documents to their desired position in an accumulator bin to an overlying position that may be on top of a previously deposited document. There currently are a number of problems that exist as to how this is accomplished with reliable mechanism and components to effect the final desired collation. The final collation may be one sheet or document, or many, depending on the job being processed. Using presently available document accumulator systems presents a problem because of the physical nature of part of the conveying systems and associated ramp devices leading into the accumulator bins. For example, presently available accumulators typically have an assembly of intermediate transport devices with "O" ring belt pulleys and accompanying "O" rings that are wrapped about the pulleys that have small diameters. These intermediate assemblies provided with small rollers and accompanying ramp members are used to propel a succeeding document over a waiting document in the accumulator bin in order to form a collation.

The use of ramps having a series of small rollers that "O" ring belts move over and under is a common way to effect the direction of the documents over the ramp. Within these accumulator designs, wear and tear on the "O" rings is a problem requiring a service call to replace the belts as they wear due to reverse flexing at high speed because the belts traverse the small support rollers in the area of the ramps. The other problem is that these types of ramps and conveyors will not properly bend a collation that is composed of multiple sheets or documents having greater thickness than a single sheet or document. The nature of bending the sheets or documents around small diameter rollers and pulleys in the intermediate conveying area of the accumulator is necessary in order to provide the desired accumulation of documents in either regular of reverse order. Subsets or collations of documents of thickness greater than a single sheet that traverse the intermediate conveying area of the accumulator conveying system leading to the accumulator bin often jam or become skewed in that area, thereby causing a machine malfunction requiring downtime for the processing equipment.

The processing speed of sheets or documents being conveyed through such equipment is increasing with the need for increased quantities of documents to more and more delivery points that meet customer needs. The material that the documents represent includes customer financial statements, credit card statements and the like. The documents as accumulated in sets, subsets or collations are delivered to the public in mailing envelopes through the USPS as they are supplied through the high-speed document processing equipment and inserting machines. The need for increased speed in order to process such material and documents only adds to the problem of wearing belts, and therefore reduced running time of the equipment due to service needs including replacement of damaged conveying belts. In addition, the increased speed of the sheets and documents means that careful attention must be paid to how the leading end of those sheets and documents arrive at the document accumulators and their respective accumulator bins. Another problem presented by the prior art is that the increased speed and velocity of the documents or sheets easily causes deflection of the sheets due to air resistance and obstructions including diverting mechanisms and ramps such as those described above having sharp bending points that can distort portions of the sheets. Improper guiding devices or conveying devices will extend the problem of sheet or document damage during their conveying motion through the intermediate diverting area of the sheet or document accumulator where the typical accumulator bin is located.

The other problem that may be present in the higher speed sheet processing equipment using sheet or document accumulators is that the sheets may be unintentionally overlapped so that they are uneven at their leading end. This may cause a jam for the reasons explained above. Once in the accumulator bin of the document accumulator, overlapped sheets or documents require justification at their leading edge in order to be subsequently released to the next stage of processing such as a folder module. If a sheet, a document or a collation is not properly squared off, justified or registered, an improper fold in the folder module typical of such processing equipment will occur. Improperly folded documents or collations will not enter envelopes waiting downstream in the document processing system. Therefore, it is desirable to have the sheets or documents justified after they enter the collating bin as much as possible to avoid having a jam occur within the next process station such as a folding device, folding module or inserting station.

There is prior art for the placement of certain accumulator ramps that are utilized inside of the accumulator or collator, including specific application of the ramp design. An example is U.S. Pat. No. 5,484,255 to Lowell and another is U.S. Pat. No. 4,640,506 to Luperti et al. The ramps are principally of static design and are typically assembled and positioned initially at the factory, and then according to need of the customer moved manually by a machine operator in order to process different sizes of documents. Depending on whether the subset or sub collation of documents needs to be over or under the preceding set of documents in the accumulator bin, the position of the ramps may need to be adjusted between cycles of operation. In the course of the adjustment procedure, there may be an error, and a subsequent jam if the ramps are not reassembled correctly, or miss-assembled in the wrong position in one or more directions such as laterally across the width of the sheet or document. Improper positioning of the ramps could mean damaged customer documents, thereby resulting in additional off-line operator intervention to repair lost documents or document damage. The re-maining problem is that these types of ramps or diverting devices do not lend themselves to bending subsets of documents that are in shingled relationship as stated above.

An example of the new technology for high speed mail production is U.S. Pat. No. 6,161,828 to Sussmeier in which is described the process of shingling sheets or documents in order to save space and increase document production. Because of the necessity for increased speed of mail production, it is important that after the input documents are separated by the available high speed feeders and compressed into shingled relationship, that the shingled sheets, or documents have a processing machine such as the sheet or document accumulator in order to keep the inserting system in equilibrium. The combination of the input feeding devices, and the document or sheet accumulator having a conveying system with appropriate diverting devices within their transport paths are needed to deliver those shingled sheets or documents to the inclusive accumulator bins to be justified and registered in order to be properly processed in downstream located equipment.

SUMMARY OF THE INVENTION

In light of the conventional prior art and the problems identified herein, the present invention addresses unfulfilled needs in a manner as will be discussed below. The present invention includes a document processing and collating machine including an inserter wherein a power operated deflecting ramp is utilized.

In combination with the power operated deflecting ramp (otherwise known as a diverting apparatus), there is disclosed herein a system for handling shingled documents in collations, groups or subsets of sheets or documents that are advanced along a document processing path towards an document accumulator. The shingled documents are in effect squeezed together at the input side of the inserting equipment as described in the aforementioned Sussmeier reference. While the aforementioned equipment described in Sussmeier feeds the documents forward, they are in a shingled state, and are subsequently squeezed together to a shingled dimension that reflects optimum processing speed while permitting deflection of the leading end of the collation of documents into an accumulator bin.

This effectively increases the throughput of the input side of the document processing equipment. Prior to the design offered by Sussmeier, the documents were processed head to tail, with no shingling or squeezed together relationship. This new system as defined by Sussmeier may be utilized in the present invention to divert the shingled documents into collating bins in a. document accumulator and thus continue the accelerated process for producing increased volumes or sets of documents at greater throughput than ever produced before in inserting equipment. This in combination with other benefits of the present invention will solve the problems of the prior art, and will further demonstrate the increased efficiency of the document processing systems where collations of sets of documents, sub-sets of documents and collations of documents are assembled in a document accumulator or collator for further processing.

In the present invention, sheets or documents that have been shingled, or compressed together by a high-speed compression device are justified (registered) in a collating apparatus document accumulator, accumulator bin before being sent forward or downstream in the system. The shingled sheets or collations are typically subsets of documents to be provided to a customer or client. In addition, later subsetting of additional documents into the justified or registered collation that may be waiting in the accumulator bin is achieved. This is accomplished through the use of and manipulation of actuated diverting ramps that are placed in the path of the documents leading into each document accumulator-collating bin. Depending on the attitude (positioned upwardly) of the ramp, the collation, an individual sheet, or a subset of the collation involving additional sheets or a set of documents is forced up and over any prior subset of documents waiting in the document-collating bin. Those sheets are then conveyed towards the desired registering position in the bin or on top of the previously deposited collation that is already registered at a stopped conveyor nip associated with conveyor rollers.

In this way, a collation of documents or sheets is formed in response to an order or machine command that formulates the documents in pre-disposed sets as processed upstream in the document-processing machine. Even if the sheets are closely shingled together, the sheets will be eventually justified (registered) within the accumulator bin and advanced as a set into additional downstream processing modules. These accumulated and registered collations may then be delivered to a folding module or other sheet or document processing module or machine located just downstream of the accumulator, or to other document processing equipment. An inserting machine is very typical of where selected groups of sheets are accumulated in bins within such accumulator modules or transport modules. Typically, the sheets are accumulated in one or more bins arranged serially, or vertically, such as that disclosed in Pitney Bowes, U.S. Pat. No. 5,083,769 to Young, Jr.

The present invention provides a document processing and collating machine having a feeding path leading to one or more document accumulating bins for receiving a series of documents that are fed downstream in spaced apart collations or subsets having documents in shingled relationship. There is at least one input conveying apparatus included that conveys a stream of shingled documents along the feeding path to a document conveying apparatus for accepting the collation of the shingled document from the diverting apparatus into at least a first document accumulating bin within the document conveying apparatus.

The document conveying apparatus has a first set of conveyor support rollers at an input end, and a second set of conveyor support rollers at an output end. There is an intermediate conveying and diverting apparatus including a segmented roller located within a span between the first and second set of conveyor support rollers of at least one document conveying apparatus for momentarily intercepting a leading end of a shingled collation of documents for deposit in at least one document accumulating bin of the document accumulating apparatus thereby providing registration of the leading end of the shingled collation of documents at the second set of conveyor support rollers in the collating accumulating bin. There is a drive system operatively connected to a sensing system and a control system to stop and start the second set of conveyor support rollers.

In addition, the document conveying apparatus has a drive system operatively connected to the document conveying apparatus and the segmented drive roller

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
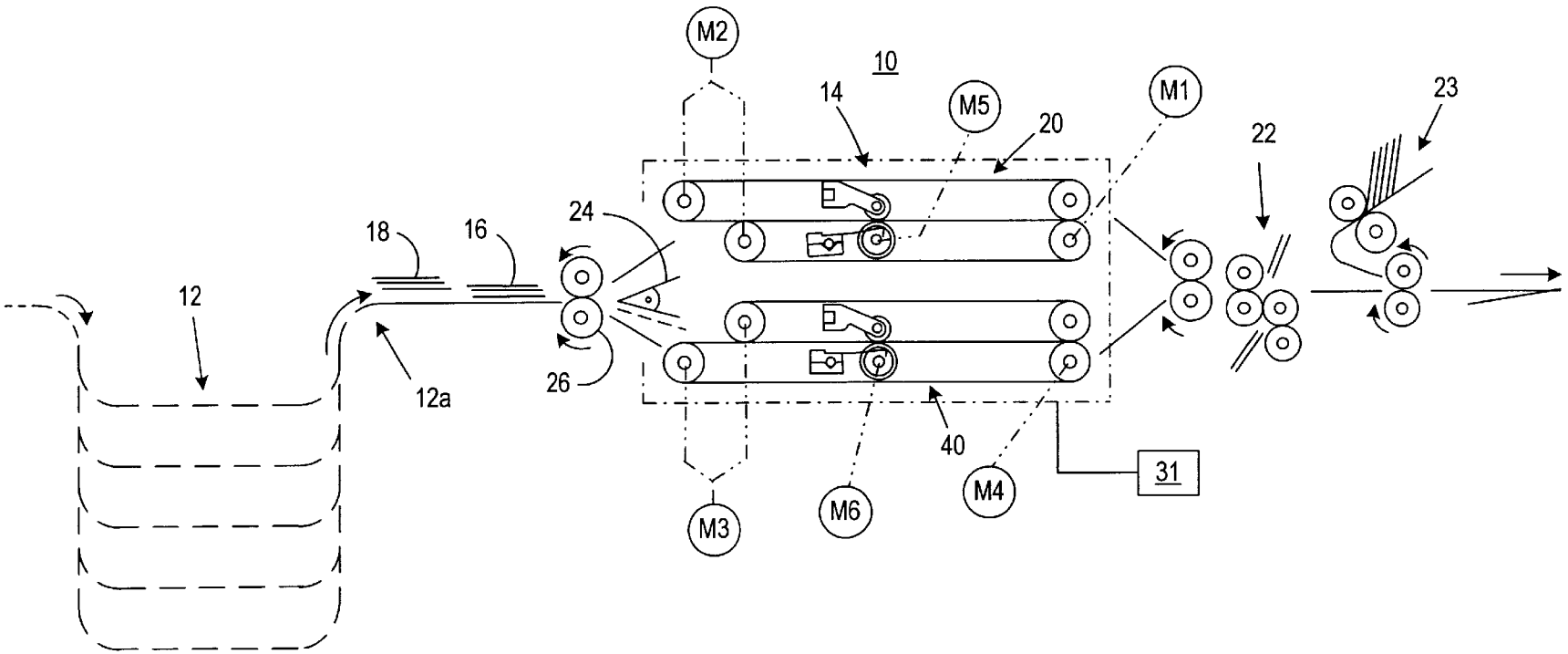
FIG. 1 is a schematic elevation view of a portion of a document processing and collating apparatus including a dual accumulator utilizing the present invention.

In describing the present invention, reference is made to the drawings, wherein there is seen in FIG. 1 a schematic of a document processing and collating machine 10. The document processing and collating apparatus 10 includes an input conveying apparatus 12 that is similar to that disclosed in U.S. Pat. No. 6,161,828 to Sussmeier et al and specific reference to FIG. 5*e* in the drawings of that reference as illustrated in FIG. 1. The Sussmeier reference ('828) discusses the details of shingling sheets or documents as such, and which are processed according to requirements of master control documents of sets of customer documents. The effect of the processing creates groups of documents such as a set of shingled documents 16 (otherwise known as a document collation, a subset, a sheet collation, or a first stream of shingled documents) and a second set of shingled documents (also known as a second stream of shingled documents) 18 shown exiting the input conveying apparatus 12 in serial fashion. There typically is a minimal gap between such sets, groups, collations or subsets of documents, the intent being to increase throughput of the machine to every extent possible.

Located immediately downstream of the input conveying apparatus 12 is a document conveying apparatus 14 (otherwise known as a dual accumulator or dual collator) composed of two separate document accumulating bins including an upper document accumulator 20 (or first document accumulator) and a lower document accumulator 40 (or second document accumulator). There is a diverting apparatus 24 located immediately downstream of a set of conveying rollers 26 that accept all sheets in single or shingled form that are conveyed forward from an output side 12*a* of the input conveying apparatus 12. The sheet deflector 24 is actuated by an electromechanical device (not shown) according to the number of sheets being processed in the apparatus 10 and instructions read from the master control document (otherwise known as a address bearing document). The master control document or address-bearing document is typically associated with each set of sheets, documents, collations, or subsets in such sheet processing equipment as is well known and discussed in patents such as U.S. Pat. No. 4,753,429 to Irvine et al. A definition of "address bearing document" is taken from the '429 patent wherein "the phrase, "address bearing document" is taken to mean a document which recites the name and address of the person or organization to which all of the documents together are to be directed, as by the Postal Service."

Referring again to FIG. 1, there is a folding module 22 located just downstream of the document conveying apparatus 14, and downstream of that is an envelope-inserting module 23. The inserting module 23 accepts the folded sets of documents that are deposited and folded in the folding module 22 which are then advanced to the inserting module 23 before delivery to an output station (not shown).

Figure 2:
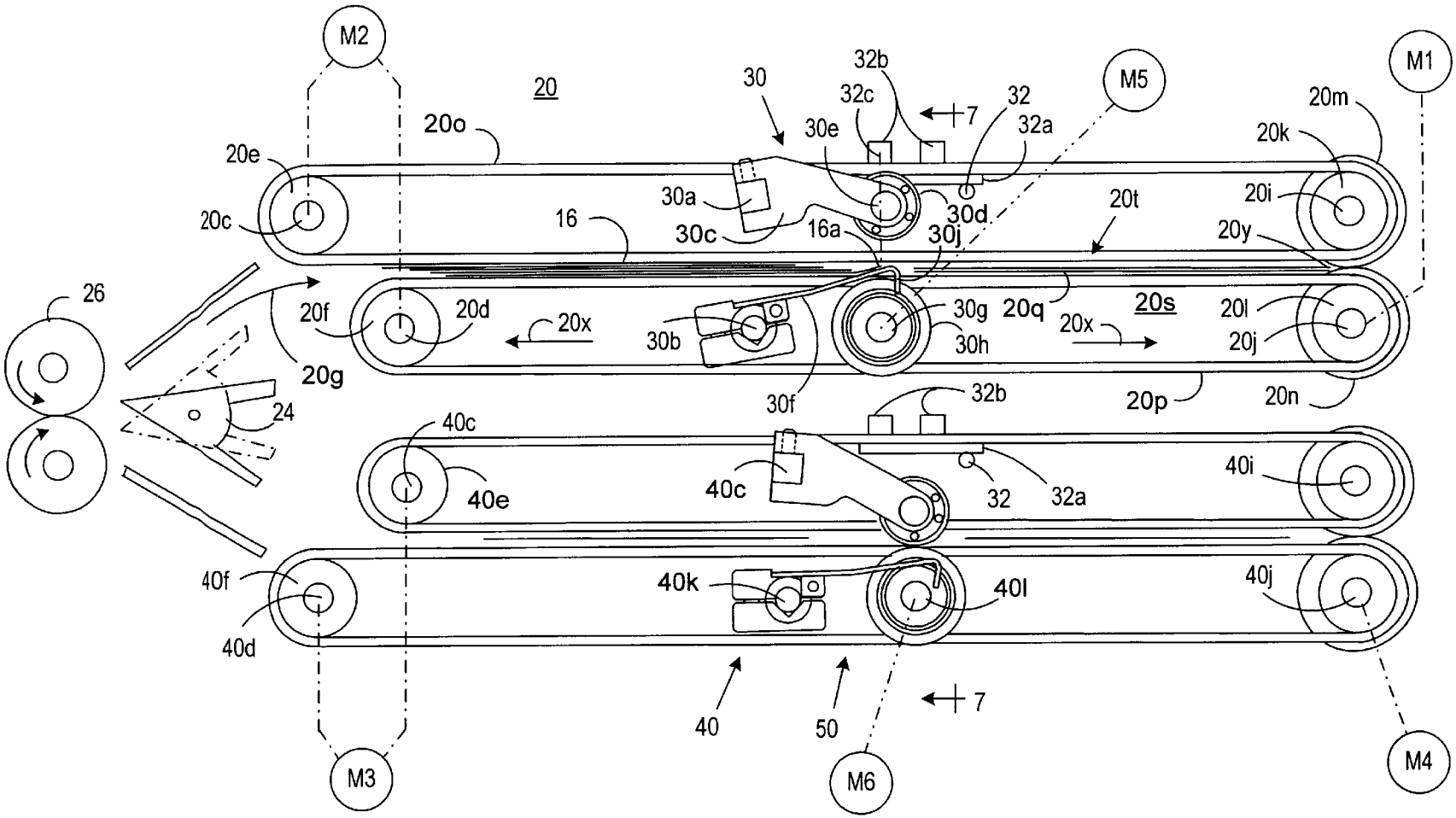
FIG. 2 is an enlarged elevation view taken along the lines of FIG. 1, showing the document conveying apparatus (dual accumulator) with sheets being processed (sheets illustrated as composite dark lines)
Figure 3:
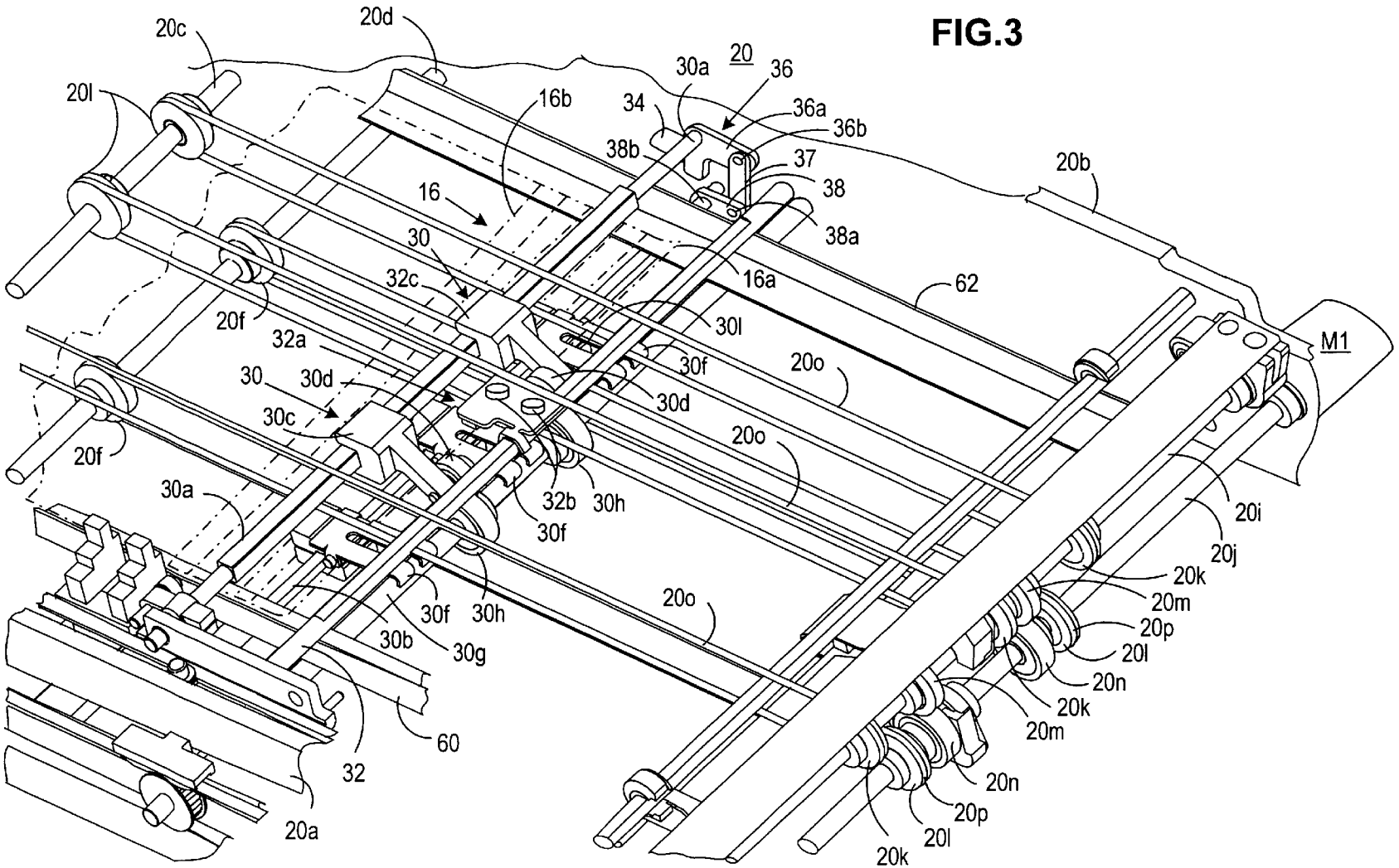
FIG. 3 is an isometric view of the document-conveying device.

Referring now to FIG. 2 and FIG. 3, the structure supporting the document conveying apparatus 14 and associated upper document accumulator 20 and lower document accumulator 40 is now described. It will be understood by those skilled in the art that there is supporting frame structure fastened to the main structure (not shown) of the document processing and collating machine 10 including a front frame 20*a* (FIG. 3) and a rear frame 20*b* for the upper document accumulator 20 and lower document accumulator 40. It is common to support shafts, motors, rollers, and other paper moving instruments in side frames such as the frame 20*a* and

20*b*. The frames 20*a* and 20*b* in turn support bearings and other hardware to hold the rollers, shafts and other components described above to form a frame like structure similar to that shown in FIG. 2 of U.S. Pat. No. 5,083,769 to Young, Jr. In FIG. 2 of the present invention, the upper document accumulator 20 has a first pair of "O" ring pulley supporting shafts, defined by a shaft 20*c* and 20*d* that support a first series of grooved "O" ring pulleys 20*e* and 20*f* respectively. To help understand the components described above in reference to FIG. 2 of the instant invention, reference is made frequently to FIG. 3, an isometric drawing of the document conveying apparatus 14 as seen from an overhead, front side of the document processing and collating apparatus 10. The front frame 20*a*, and rear frame 20*b* is seen along with the many supporting shafts that hold the grooved "O" ring pulleys such as the "O" ring pulleys 20*e*, 20*f*, and others to be described next.

Referring to FIGS. 2 and 3, the first and second series of grooved pulleys 20*e* and 20*f* are spaced apart on each supporting shaft 20*c* and 20*d* respectively. This is much similar to that shown in the aforementioned reference '769, and is shown in later figures of the present invention and described later in this specification. The pulleys 20*e* number three on the shaft 20*c* (2 shown), and there are two pulleys 20*f* on the shaft 20*d*. The series of pulleys 20*e* are spaced longitudinally towards the diverting apparatus 24, and the series of pulleys 20*f* are slightly indented longitudinally towards the downstream side of the collating machine 10.

This arrangement provides a clear path of entry into either the upper or lower accumulator 20 or 40. For example, there is a feed path 20*g* that leads a collation into an accumulator bin (described later) in the document conveying apparatus 20 upon leaving the area of the diverting apparatus 24. In FIGS. 1 & 2, there is a motor M2 shown that drives the shafts 20*c*, & 20*d* by conventional power devices such as timing belts or direct connection to those shafts. Separately, for a shaft 30*g* and a shaft 40*d* there is a motor M5 and M6 (FIGS. 2 & 7) that drives the shafts 30*g* and 40*d* respectively in order to match transport velocities of the attached "O" ring belts (to be described next). Mounted on the shaft 30*g* is a series of roller segments 30*h* that are driven so that the tangential velocities of those rollers agree with the attached moving "O" ring belts.

The purpose of the drive motors M2, & M3 is to continuously drive the first series of "O" ring pulleys 20*e*, and a series of "O" ring pulleys 40*e*, and 40*f* mounted on the shafts 40*c* and 40*d* respectively. The "O" ring pulleys are continuously driven to insure that sheets or documents spaced apart within the upper and lower accumulators 20 and 40 are moved downstream to the accumulating bin located therein and within each of the accumulators 20 and 40. Other rollers and conveying apparatus associated with the upper and lower document conveyors 20 and 40 are stopped and started as will be described later.

There is also a set of shafts 20*i* and 20*j* arranged downstream in the document conveying apparatus 14 and associated upper accumulator 20. The shafts 20*i* and 20*j* have an accompanying set of pulleys 20*k* and 20*l* mounted in a similar manner as that described with reference to the pulleys 20*e* and 20*f*. This arrangement is such that sheets or documents of standard length (such as 8½×11 inches) will fit intermediate of (longitudinally between) the first pair of supporting shafts 20*c*, 20*d* and their accompanying hardware described above in reference to the first set of "O" ring pulleys 20*e* and 20*f*, and the downstream shafts 20*i*, 20*j* and the accompanying second set of pulleys 20*k* and 20*l*. In addition the document conveying apparatus 20 is further constructed so that, the sheets or documents (such as the first set of shingled documents 16) fit inside of a first document accumulator bin 20*t* located at a downstream end 20*s* of the document conveying apparatus 20. There is also an intermediate diverting mechanism (to be described later) spaced between the aforementioned shafts 20*c*, 20*d*, pulleys 20*e*, 20*f*, shafts 20*i*, 20*j*, pulleys 20*k*, 20*l*, and a series of rollers 20*m* and 20*n* mounted on the shafts 20*i* and 20*j* respectively.

Within the first document accumulator bin 20, there is a total of five "O" ring belts (FIG. 3) such as "O" ring belt 20*o*, all mounted on corresponding sets of "O" ring pulleys 20*e*, 20*f* and 20*k* and 20*l*. The series of "O" ring pulleys 20*e*, 20*f*, 20*k* and 20*l* as well as the series of rollers 20*m* and 20*n* mounted on the shafts 20*i* and 20*j* are spaced apart as is seen in FIG. 3. The series of rollers 20*m* and 20*n* are attached to the shafts 20*i* and 20*j* respectively, and the shaft 20*j* is attached to a motor M1. The motor M1 is utilized for intermittent start and stop operation as will be explained later to register or convey the collations, subsets, etc. of the documents or sheets. There is a corresponding motor M4 located on a shaft 40*j* in the lower accumulator 40 that has the same function as the motor M1. The collation conveyors within the document conveying apparatus 14 includes the series of "O" ring belts 20*o* and 20*p* that are suspended on the accompanying pulleys 20*e*, 20*k*, and 20*f* and 20*l* respectively. The "O" rings and associated pulleys may also be substituted with flat belts and accompanying pulleys or the equivalent for the purposes defined in the present specification.

Referring to FIG. 3, there is an intermediate conveying and diverting apparatus 30 located within a span 20*x* between or intermediate of the aforementioned shafts 20*c*, 20*d*, and 20*i*, 20*j* and their respective hardware as described above. The intermediate diverting apparatus 30 is suspended in the aforementioned frames 20*a* and 20*b* and arranged for articulating parts of the diverting apparatus 30 as will be explained next.

A shaft 30*a* supports a series of bearing support arms 30*c*, each arm 30*c* supporting a roller bearing (ball bearing) 30*d* mounted on each arm 30*c* by a suitable pin 30*e*. The series of bearing support arms 30*c* are securely fastened to the shaft 30*a* by conventional mechanical fastening devices. Mounted on a lower shaft 30*b* is a series of deflector assembly's 30*f*, which when raised are instrumental in deflecting a leading end of a stream of documents or sheets, approaching the diverting apparatus 30. There is a driven shaft 30*g* which supports the set of roller segments 30*h*, and which form a nip with each roller bearing 30*d* in order to provide a normal force and conveyance for the shingled documents moving towards the first document accumulating bin 20*t* within the document accumulator 20.

The collation diverting function becomes active upon enabling of the associated intermediate conveying and diverting apparatus 30 which occurs upon sensing of the leading end of a collation of documents being advanced along the feed path 20*g* towards the apparatus 30.

Referring to FIGS. 2 & 3, there is shown a shaft assembly 32 that is fixed to support a sensor assembly 32*a* and a pair of sensors 32*b*. The sensors 32*b* initiate a diverting position of the diverting assembly 30 when a collation or subset of shingled documents such as the set of documents 16 approaches the diverting apparatus 30. The sensors 32*b* and other electronic devices are connected to a control system 31 (FIG. 1) that is used to coordinate different signals from sensors such as 32*b* in the document processing and collating machine 10. A leading end 16*a* of the set of documents 16 is the first document of the set 16, and that triggers a first sensor 32*b*, so that the series of deflector ramp assembly's 30*f* are raised within the first document accumulator 20 as shown in FIG. 2. In FIG. 3, the ramp assembly's 30*f* are shown with a slot 30*l*, that permits the "O" ring 20*o* to pass through when the ramp assembly's 30*f* are raised.

Figure 2A:
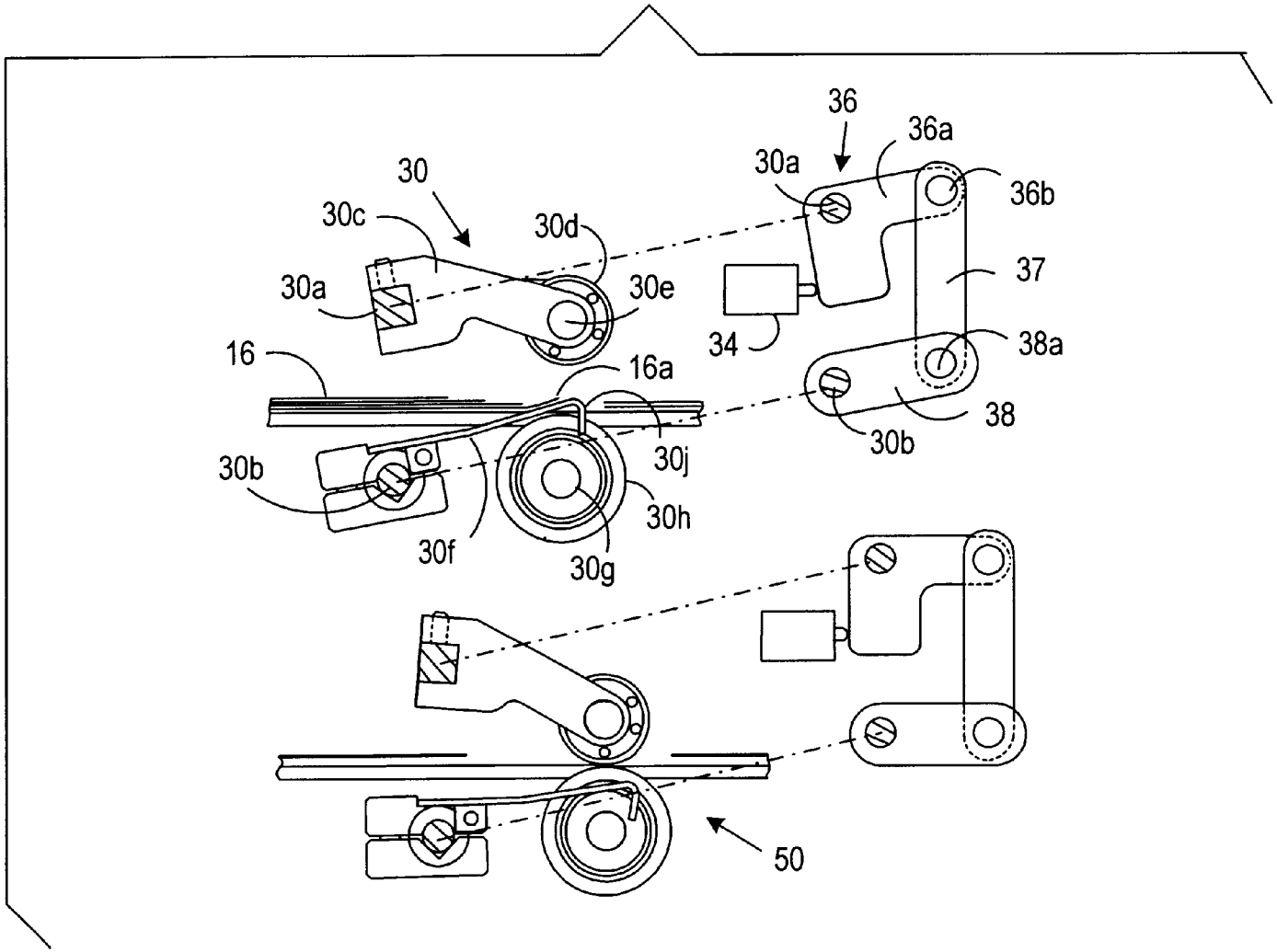
FIG. 2*a* is a view taken along the lines of FIG. 2, broken away to show components within the upper and lower document accumulators that are related to the linkage attached to the diverting apparatus within the accumulators.

Referring to FIG. 2*a* and FIG. 3, there is a solenoid 34 that is enabled by the control system 31 when the leading end 16*a* of the collation 16 passes the sensor 32*b* (shown in FIG. 2 as a sensing line 32*c*). The solenoid 34 is mounted to the rear frame 20*b* and aligned to engage a bell shaped arm 36 that pivots on the shaft 30*a*. An arm 36*a* of the bell shaped arm 36 has a connecting pin 36*b* that is engaged with a link 37, and the link 37 is further engaged with an arm 38 through a pin 38*a* connecting there between. The arm 38 is attached by suitable devices to the shaft 20*d*, and is therefore rotated with the shaft 20*d* with its attached series of ramp assembly's 30*f* to a raised position 30*j*.

Figure 4:
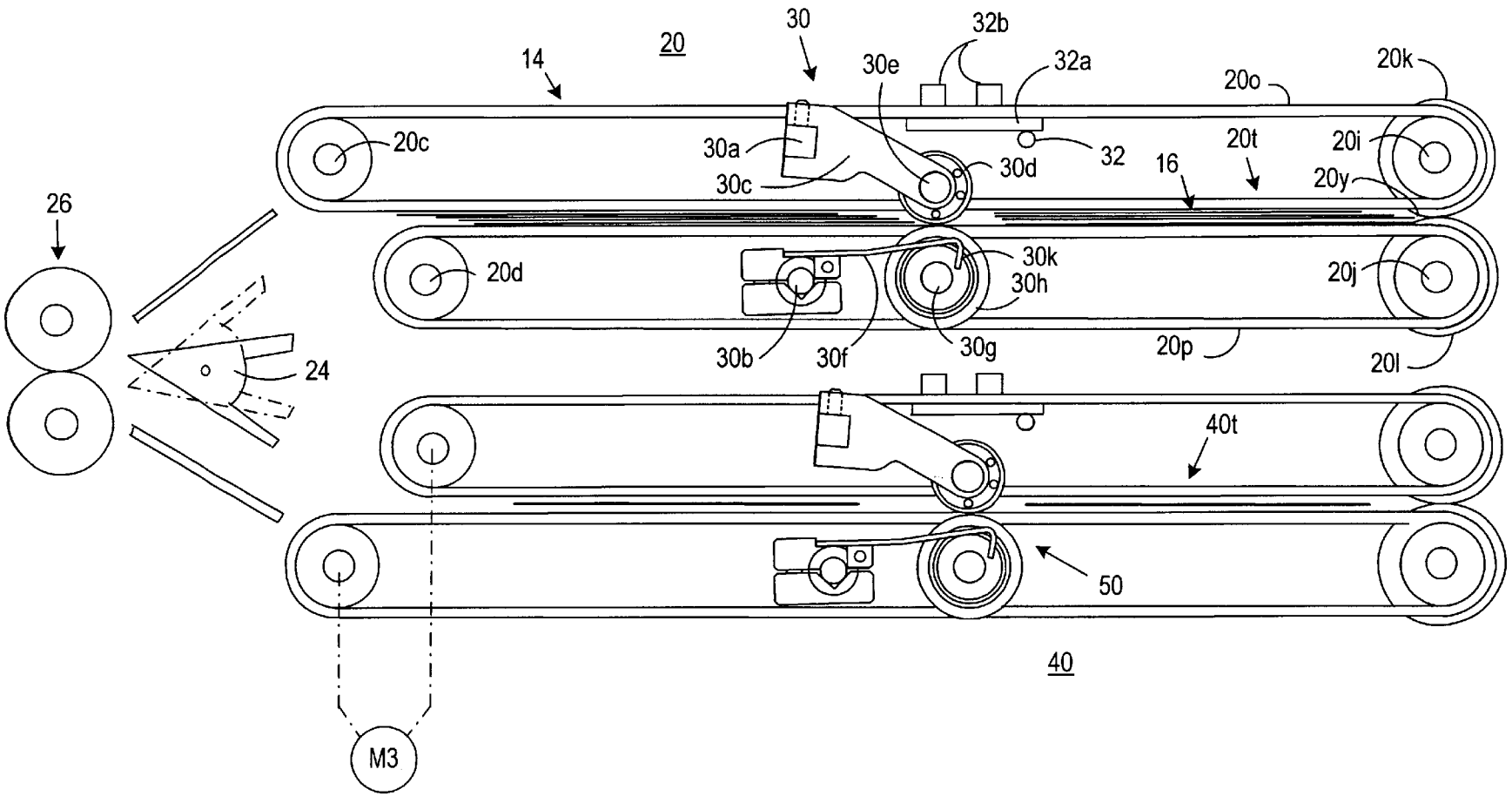
FIG. 4 is an enlarged elevation view taken along the same lines of FIGS. 1 and 2, with the conveying devices slightly separated, illustrating the position and alignment of the sheets being processed to move into the upper document accumulator while a collation of sheets is shown moving along the feed path in the lower document accumulator.

The ramp assembly's 30*f* are only held at the raised position 30*j* for an instant, since actuation by passing leading end 16*a* of the collation 16 causes the second sensor 32*b* (FIG. 2) (both sensors are labeled 32*b*) to immediately (through control system 31) drop the ramp assemblies' 30*f* back to a starting position 30*k* (FIG. 4). Since the set of documents is still shingled all documents following the leading end 16*a* of the set 16 follow the first document associated with the leading end 16*a*, directly into the bin 20*t*. If there is a previous subset of documents already in the first document accumulator bin 20*t*, the new collation of documents is dropped on top of that waiting collation or subset of documents. A collation 20*q* is shown waiting in the first accumulator bin 20*t* (FIG. 2).

Referring to FIG. 2 and FIG. 4, the set of rollers 20*m* and 20*n* within the upper document accumulator 20 are engaged to form a nip 20*y* that is the registration point for the set of documents 16 being driven forward (FIG. 4) by the combined conveying apparatus including the "O" ring belts 20*o* and 20*p*, and the roller segments 30*h* in contact with the roller bearings 30*d*. The "O" ring belts 20*o* and 20*p* will continue driving the set of documents 16 forward (downstream) towards the nip 20*y*. In FIG. 2, the rollers 20*m* and 20*n* do not rotate (motor M1 is not actuated) since a period of time will evolve before the first set of documents 16 completely passes the area of the intermediate conveying and diverting apparatus 30. When an edge 16*b* of the last document in the first set of shingled documents 16 passes the downstream sensor 32*b*, the motor M1 is enabled and will engage the shaft 20*j* to drive the set of shingled documents 16 (now registered with a common lead edge) downstream towards the folder module 22. The roller 20*n* is normally driven by the motor M1 and conveys sheets or documents ready to be advanced if there is no subset accumulation occurring in the process.

Figure 5:
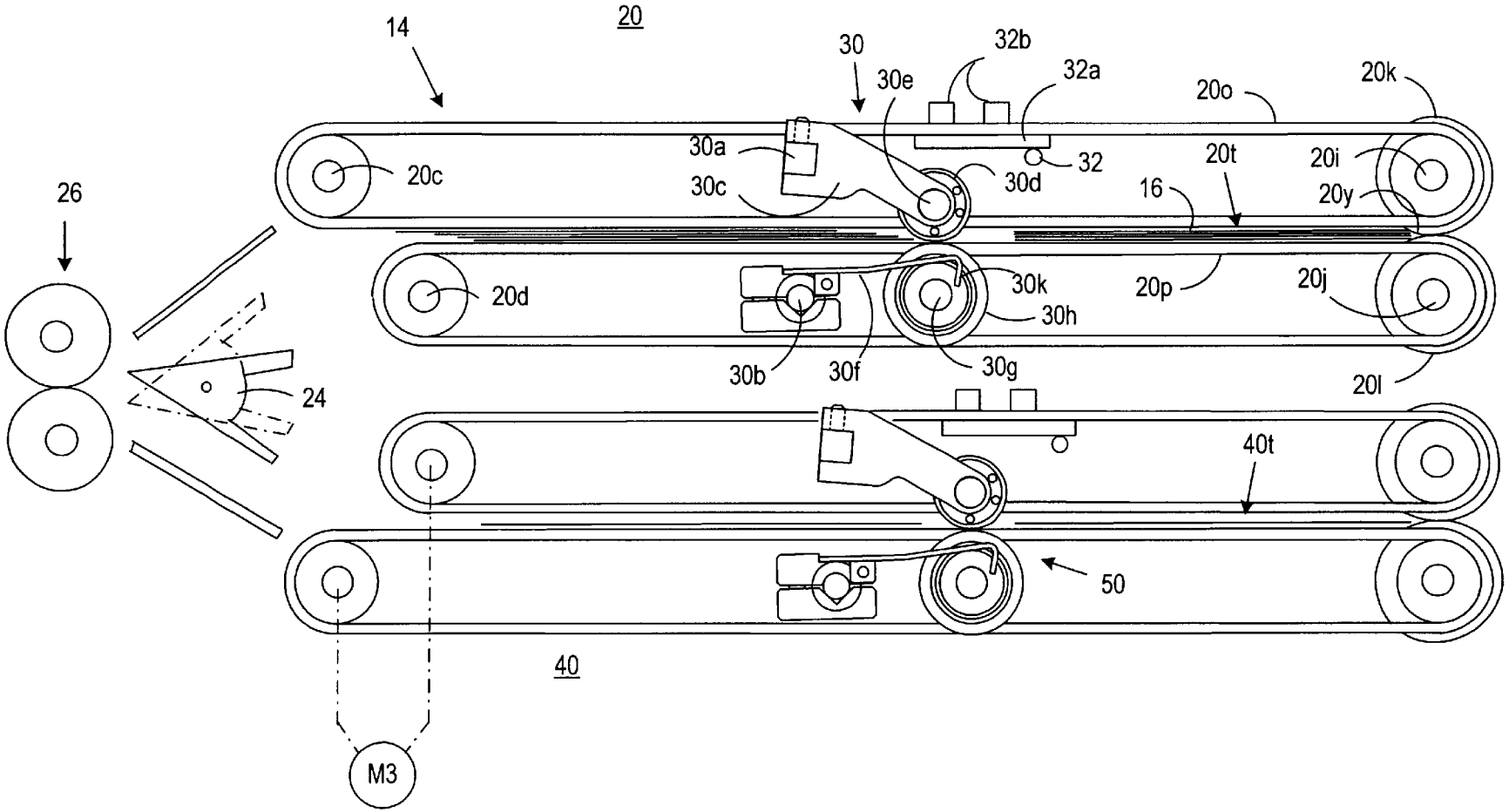
FIG. 5 is an enlarged elevation view taken along the same lines as FIG. 2, showing the documents being processed in the dual accumulator.

Referring to FIG. 5, the set of documents 16 is seen as it is registered at the nip 20*y*. At an appropriate time in the cycle of the document processing and collating apparatus 10, the roller combination of 10*n* and 10*m* will be enabled (when motor M1 is enabled), thereby driving the collation or set of documents 16 forward (downstream) towards the folding module 22. At this time the first set of shingled documents 16 is no longer shingled, having been registered and aligned at the nip 20*y*.

The lower accumulator bin 40 operates in the same manner as that described above for the first document accumulator bin 30 if for example the second set of documents 18 is being processed in the document processing and collating apparatus 10. The diverting apparatus 24 would be enabled to guide a leading end 18*a* of the second set of documents 18 into the lower accumulator bin 40, (FIG. 5) to be registered at a nip between similar rollers as that defined above with reference to rollers 20*m* and 20*n*.

Alternatively, the lower accumulator bin 40 will act as a transport for sheets or documents without registration and will pass those sheets straight through the accumulator as is seen in FIG. 2. In that case a diverting apparatus 50 (equivalent to the diverting apparatus 30) of the first document accumulator bin 30 would not be activated according to instructions provided in the address-bearing document of the set of documents or sheets. This would likely be the situation where a series of single documents or sheets are being processed through the machine 10 (FIG. 2) and as such may pass directly from the lower accumulator to downstream modules for processing.

Figure 6:
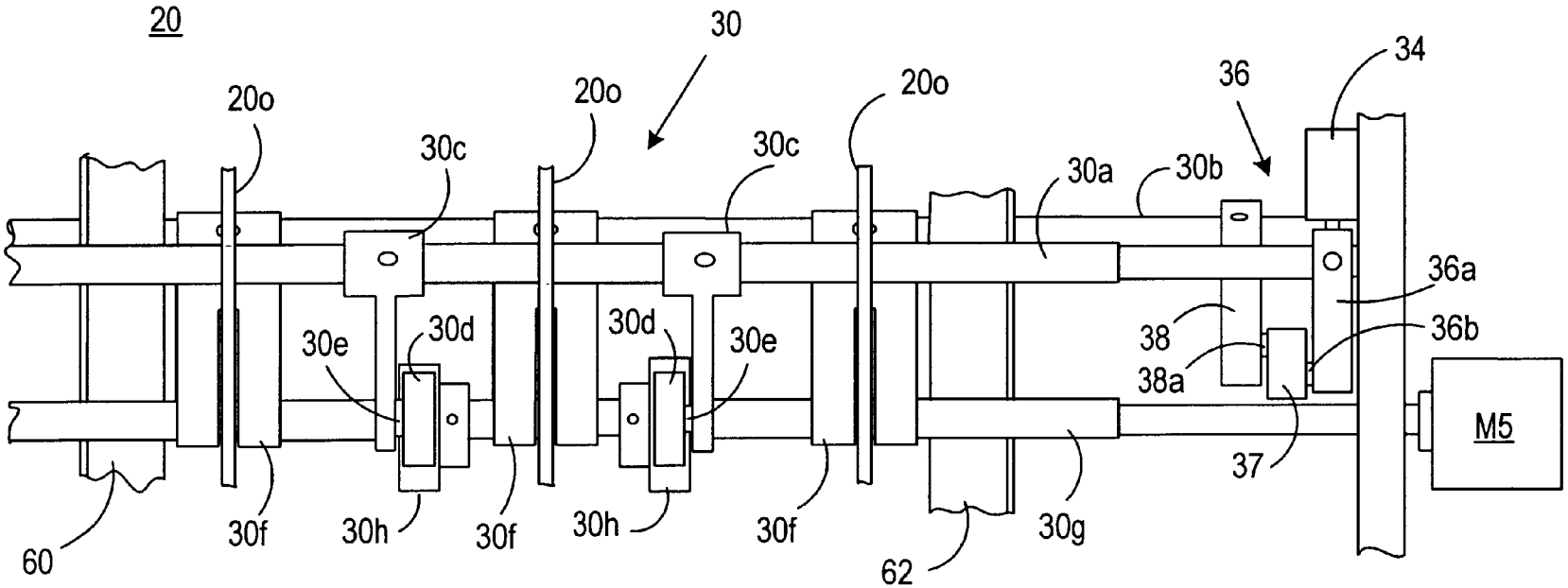
FIG. 6 a partial view of the top of the apparatus, showing the intermediate conveying and diverting apparatus associated with the top accumulator bin to ramp the documents into an overlying relationship of waiting documents in the accumulator bin.
Figure 7:
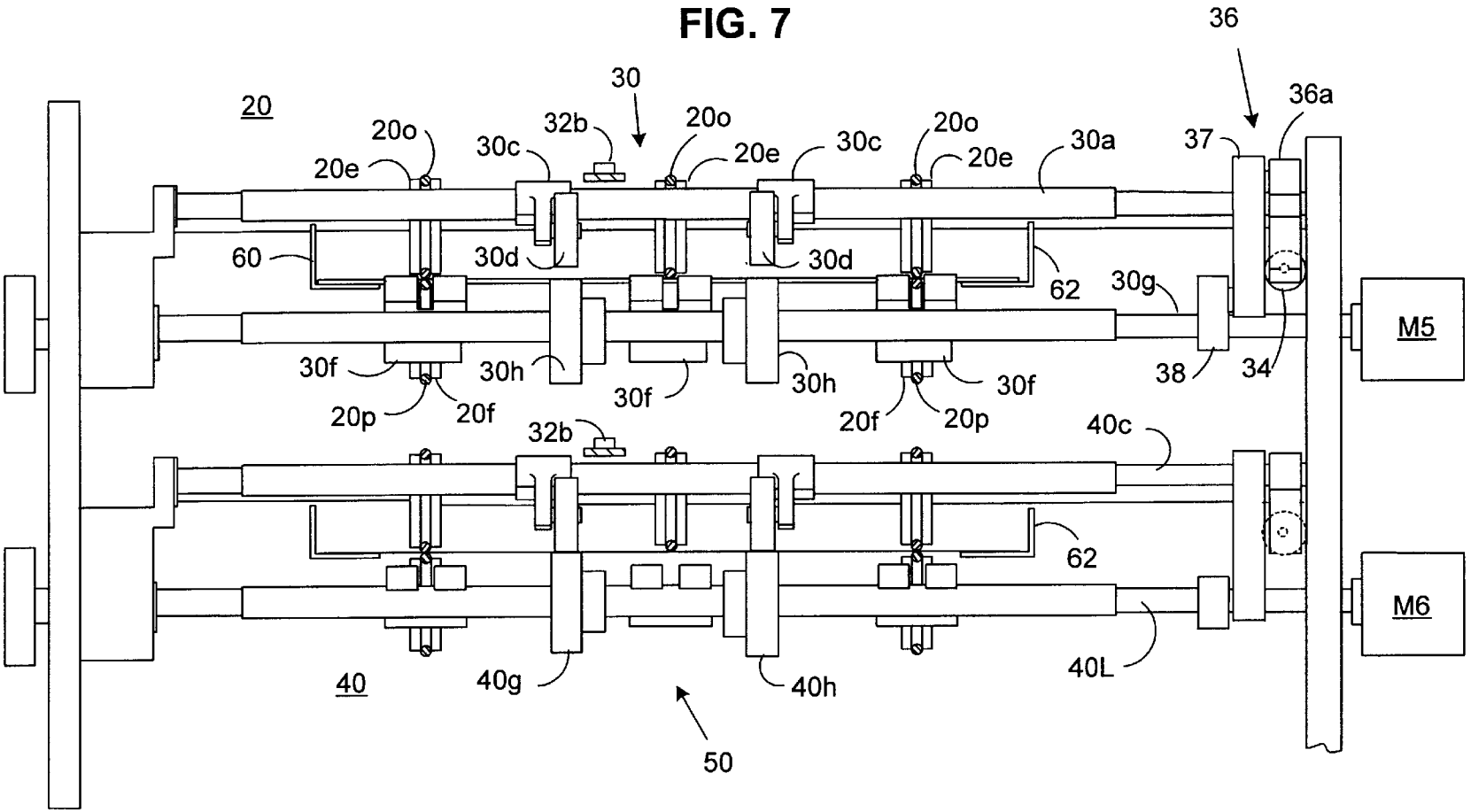
FIG. 7 is a section view taken along the lines of 7—7 from FIG. 2.

Additional views that may assist the reader in understanding the present invention include FIG. 6 and FIG. 7. FIG. 6 helps to understand the relationship of the Intermediate conveying and diverting apparatus 30, and the series of deflector ramp assemblies 30*f* with respect to the actuating mechanism namely identified as solenoid 34, the bell shaped arm 36, the link 37, and the lower arm 37 that is secured to the shaft 30*b* by conventional locking devices (a setscrew). This arrangement is so that the series of ramp assemblies' 30*f*, also fastened to the shaft 30*b* are raised when the solenoid 34 is energized as discussed above. It will be understood by those skilled in the art that the lower document accumulator 40 has the same instrumentalities as those defined above in respect to the intermediate conveying and diverting apparatus 30, and the lower diverting apparatus 50 is enabled as needed to divert additional shingled document subsets into an accompanying accumulator bin 40*t* when the control system 31 directs such a subset or collation from actuating the diverting apparatus 24.

In FIG. 6, the motor M5 is seen as attached to the shaft 30*g* (this may be replaced by a connecting drive apparatus (timing belts, or linked chain not shown) that would agree with conveying speed provided by the motors M1, and M2 to the "O" ring belts 20*o* and 20*p*). The motor M5, and the motor M6 (FIG. 7) are used to make the speed of the collations, subsets etc. traveling along the document accumulator 20 conveying path substantially the same in respect to the velocity imparted on those document sets by the "O" ring belts 20*o*, 20*p* and the velocity of the roller segment 30*h* (two roller segments 30*h*) that operates in association with the accumulator 20. The "O" ring belts 20*o*, 20*p*, and the shaft 30*g* with attached roller segments 30*h* all are continuously driven, thereby always conveying the subsets, collations etc forward to the roller nip 20*y* (stopped on command under control of the control system 31 to cause registration at nip 20*y* of the documents sent into the first document accumulator bin 20*t*).

FIG. 7 is helpful in that it illustrates the relationship of the upper document accumulator 20 to the lower document accumulator 40 along with the relationship of the documents that are being transported through the two aforementioned accumulators. A front guide 60 and a rear guide 62 act as both horizontal and vertical supports for the sheets or documents passing through the accumulator 20.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A document processing and collating machine having a feeding path leading to one or more document accumulating bins for receiving a series of documents that are fed downstream in spaced apart collations having documents in shingled relationship, the document processing and collating machine comprising:

a support frame;

at least one input conveying apparatus for conveying a collation of shingled documents along the feeding path to a diverting apparatus;

a document conveying apparatus for accepting the collation of the shingled documents from the diverting apparatus into at least a first document accumulator bin within the document conveying apparatus having a first set of conveyor support pulleys at an input end of the document conveying apparatus, and a second set of conveyor support pulleys at an output end;

an intermediate conveying and diverting apparatus including a driven segmented roller located within a span between the first and second set of conveyor support pulleys for momentarily intercepting a leading end of a shingled collation of documents for deposit in the first document accumulating bin of the document accumulating apparatus thereby providing registration of a leading end of the collation of shingled documents at a nip between a second set of conveyor rollers at the output end of the first document accumulating bin;

a biased conveyor pressure assembly operatively associated with the intermediate conveying and diverting apparatus by a connector attached to a pivotable assembly of diverting gate members that are raised to a diverting position upon receiving a signal of a leading end of a shingled group of documents moving along the feed path leading to the first document accumulator bin, and;

a drive system operatively connected to a sensing system and a control system to continuously drive the document conveying apparatus and to stop the second set of conveyor rollers upon receiving a signal of the passing of the leading end of the collation of shingled documents until the collation of shingled documents has completed registration at the nip of the second set of conveyor rollers.

2. A document processing and collating machine as recited in claim 1 wherein the first document accumulator bin includes an upper and lower set of belts.

3. A document processing and collating machine as recited in claim 2 wherein the first document accumulator bin includes an upper and lower set of "O" ring belts.

4. A document processing and collating machine as recited in claim 3 wherein the pivotable assembly of diverting gate members includes a parallel series of slotted guide members that are interlaced with the "O" ring belts within the slotted guide members.

5. A document processing and collating machine as recited in claim 4 wherein the intermediate conveying and diverting apparatus includes a positively driven roller shaft with a spaced apart series of roller segments that are interposed with the parallel series of slotted guide members.

6. A document processing and collating machine as recited in claim 5 wherein the biased conveyor pressure assembly includes a series of idler rollers in communication with the spaced apart series of roller segment mounted upon the positively driven roller shaft.

7. A document processing and collating machine as recited in claim 6 wherein the series of idler rollers are ball bearings.

8. A document processing and collating machine having a feeding path leading to one or more document accumulating bins for receiving a series of documents that are fed downstream in spaced apart collations having documents in shingled relationship, the document processing and collating machine comprising:

a support frame;

at least one input conveying apparatus for conveying a collation of the shingled documents along the feeding path to a diverting apparatus;

a document conveying apparatus for accepting the collation of the shingled documents from the diverting apparatus into at least a first document accumulator bin within the document conveying apparatus having a first set of conveyor support pulleys at an input end of the document conveying apparatus, and a second set of conveyor support pulleys at an output end;

an intermediate conveying and diverting apparatus including a driven segmented roller located within a span between the first and second set of conveyor support pulleys for momentarily intercepting a leading end of a shingled collation of documents for deposit in the first document accumulating bin of the document accumulating apparatus thereby providing registration of a leading end of the collation of shingled documents at a nip between a second set of conveyor rollers at the output end of the first document accumulating bin;

a biased conveyor pressure assembly operatively associated with the intermediate conveying and diverting apparatus by a connector attached to a pivotable assembly of diverting gate members that are raised to a diverting position upon receiving a signal of a leading end of a shingled group of documents moving along the feed path leading to the first document accumulator bin;

a first drive system operatively connected to the document conveying apparatus and the segmented drive roller, and;

a second drive system operatively connected to a sensing system and a control system to stop and start the second set of conveyor rollers upon receiving a signal of the passing of the leading end of the collation of shingled documents.

9. A document processing and collating machine as recited in claim 8 wherein the drive system includes a motor assembly operatively connected to the second set of conveyor rollers.

10. A document processing and collating machine as recited in claim 9 wherein the intermediate conveying and diverting apparatus momentarily diverts the leading end of the shingled collation of documents until a leading end of a second document in the shingled collation of documents is detected thereby initiating a return of the intermediate conveying and diverting apparatus to a normal non-diverting position.

11. A document processing and collating machine as recited in claim 10 wherein the return of the intermediate conveying and diverting apparatus to a normal non-diverting position occurs within 2 milliseconds of a detection of the leading end of the shingled collation of documents.

12. A document processing and collating machine having a feeding path leading to one or more document accumulating bins for receiving a series of documents that are fed downstream in spaced apart collations having documents in shingled relationship, the document processing and collating machine comprising:

a support frame;

at least one input conveying apparatus for conveying a collation of the shingled documents along the feeding path to a diverting apparatus;

a document conveying apparatus for accepting the collation of the shingled documents from the diverting apparatus into at least a first document accumulator bin within the document conveying apparatus having a first set of conveyor support pulleys at an input end of the document conveying apparatus, and a second set of conveyor support pulleys at an output end;

an intermediate conveying and diverting apparatus including a driven segmented roller located within a span between the first and second set of conveyor support pulleys for momentarily intercepting a leading end of a shingled collation of documents for deposit in the first document accumulating bin of the document accumulating apparatus thereby providing registration of a leading end of the collation of shingled documents at a nip between a second set of conveyor rollers at the output end of the first document accumulating bin;

a biased conveyor pressure assembly operatively associated with the intermediate conveying and diverting apparatus by a connector attached to a pivotable assembly of diverting gate members that are raised to a diverting position upon receiving a signal of a leading end of a shingled group of documents moving along the feed path leading to the first document accumulator bin;

a first drive system operatively connected to the document conveying apparatus and the segmented drive roller, and;

a second drive system operatively connected to a sensing system and a control system to stop and start the second set of conveyor rollers upon receiving a signal of the passing of the leading end of the collation of shingled documents.

13. A method for processing a stream of shingled documents fed along a feed path in a document processing and collating machine leading to one or more document accumulating bins for receiving a series of documents that are fed downstream in collations in shingled relationship, the method comprising:

advancing a stream of shingled documents from an input station;

diverting the stream of shingled documents along a first path leading to a first document accumulator;

conveying the diverted stream of shingled documents within a conveying apparatus having at least one document accumulating bin;

diverting a leading document of the stream of shingled documents upon detection of a leading edge of the leading document at a sensor operatively associated with an intermediate conveying and diverting apparatus located in a span of the conveying apparatus;

actuating the intermediate conveying and diverting apparatus upon detection of the leading edge of the leading document of the stream of shingled documents by lifting a biased conveyor pressure assembly that is connected to a pivotable assembly of diverting gate members in order to divert the leading edge of the leading document for deposit in a first accumulating bin;

halting a drive of a set of conveying rollers associated with the conveying apparatus located at a downstream end of the first collating bin in order to register the leading ends of the stream of shingled documents at a nip of the set of conveying rollers, and;

restarting the drive of the set of conveying rollers associated with the conveying apparatus when a trailing end of the stream of shingled documents is detected having passed into the first accumulating bin.

14. A method for processing a stream of shingled documents fed along a feed path in a document processing and collating machine leading to one or more document accumulating bins for receiving a series of documents that are fed downstream in staggered relationship, the method comprising:

advancing a first stream of shingled documents from an input station;

diverting the first stream of shingled documents along a first path leading to a first document accumulator;

conveying the diverted first stream of shingled documents within a conveying apparatus having at least one document-accumulating bin;

diverting a leading document of the first stream of shingled documents upon detection of a leading edge of the leading document of the first stream at a sensor operatively associated with a first intermediate conveying and diverting apparatus located in a span of the first conveying apparatus;

advancing a second stream of shingled documents from the input station;

diverting the second stream of shingled documents along a second path leading to the first document accumulator and a second document-accumulating bin;

actuating the intermediate conveying and diverting apparatus upon detection of the leading edge of the leading document of the second stream of shingled documents by lifting a biased conveyor pressure assembly that is connected to a pivotable assembly of diverting gate members in order to divert the leading edge of the leading document of the second stream for deposit in a first accumulating bin;

halting a drive of a set of conveying rollers associated with the conveying apparatus located at a downstream end of the first collating bin in order to register the leading ends of the second stream of shingled documents at a nip of the set of conveying rollers, and;

restarting the drive of the set of conveying rollers associated with the conveying apparatus when a trailing end of the stream of shingled documents is detected having passed into the first accumulating bin.

* * * * *